US007631684B2

(12) United States Patent
Roehrig et al.

(10) Patent No.: US 7,631,684 B2
(45) **Date of Patent: *Dec. 15, 2009**

(54) CONTINUOUS CASTING PLANT

(75) Inventors: Adalbert Roehrig, Thalwil (CH); Franz Kawa, Adliswil (CH)

(73) Assignee: Concast AG, Zurich (CH)

( * ) Notice: Subject to any disclaimer, the term of this patent is extended or adjusted under 35 U.S.C. 154(b) by 0 days.

This patent is subject to a terminal disclaimer.

(21) Appl. No.: 11/771,784

(22) Filed: Jun. 29, 2007

(65) Prior Publication Data

US 2008/0230202 A1 Sep. 25, 2008

Related U.S. Application Data

(63) Continuation of application No. PCT/EP2005/013078, filed on Dec. 7, 2005.

(30) Foreign Application Priority Data

Dec. 29, 2004 (EP) ..... 04030926

(51) Int. Cl.
*B22D 11/04* (2006.01)

(52) U.S. Cl. ..... 164/418; 164/459

(58) Field of Classification Search ..... 164/418, 164/444, 459

See application file for complete search history.

(56) References Cited

U.S. PATENT DOCUMENTS 4,565,236 A * 1/1986 Masui et al. ..... 164/459
2003/0070786 A1* 4/2003 Tanaka et al. ..... 164/468

FOREIGN PATENT DOCUMENTS

| | | | |
|---|---|---|---|
| EP | 0498296 | | 8/1992 |
| EP | 1547705 | A | 6/2005 |
| JP | 05138300 | A | 6/1993 |
| JP | 09262641 | A | 10/1997 |
| JP | 11151555 | A | 6/1999 |
| JP | 2001079650 | A | 3/2001 |
| JP | 2002035896 | A | 2/2002 |
| JP | 2003170248 | A | 6/2003 |

OTHER PUBLICATIONS

Mishima et al. JP Pub. No. 05-138300. Published Jun. 1, 1993. (Machine translation).*

* cited by examiner

*Primary Examiner*—Kuang Lin
(74) *Attorney, Agent, or Firm*—Darby & Darby PC

(57) ABSTRACT

The invention relates to a continuous casting installation, for example for steel billet and bloom formats having substantially rectangular or circular cross-section. The invention improves the strand structure in the corner areas, to avoid rhomboidity, cracks and dimensional imperfections of the strand cross-section while achieving a high throughput capacity per strand and reducing investment and running costs. The fillets of the groove curvatures in the die cavity amount to a proportion of the length of the side of the strand cross-section. The degree of curvature 1/R of the groove curvatures decreases in the direction of the strand at least along at least partial length of the entire casting die, thereby achieving gap elimination between the casting shell and the casting die wall and/or a targeted casting shell shaping in the area of the groove curvature. The continuous casting installation, directly downstream of the casting die, may thus be provided with a strand support-free secondary cooling zone or a supporting guide in the secondary cooling zone that is reduced in its supporting width and/or supporting length.

20 Claims, 4 Drawing Sheets

CONTINUOUS CASTING PLANT

This application is a continuation of PCT Application No. PCT/EP2005/013078, filed Dec. 7, 2005, which claims the benefit of European Application No. 04030926.2 filed Dec. 29, 2004, the entirety of which are incorporated by reference herein.

BACKGROUND OF THE INVENTION

1. Field of the Invention

The invention relates to a continuous steel casting plant for billet and bloom formats.

2. Description of Related Art

Long continuous casting products are cast predominantly in tubular permanent molds with a rectangular, and often with an approximately square or round, cross-section. The billet and bloom slabs are then further processed by rolling or forging.

For producing continuous casting products with good surface and texture quality, in particular billet and bloom slabs, a uniform heat transition along the circumferential line of the slab cross-section between the slab being formed and the wall of the die cavity is of crucial importance. Many proposals are known for designing the geometry of the die cavity, in particular in the areas of the corner fillets of the die cavity, in such a way that no damaging air gaps arise between the slab shell being formed and the wall of the permanent mold, causing an uneven heat transition along a circumferential line of the slab cross-section and solidification defects and fractures.

Corners of the die cavity of tubular permanent molds are rounded by fillets. The larger the configuration of the fillets in the die cavity of the permanent mold, the more difficult it is to achieve a uniform cooling between a slab shell being formed and the walls of the permanent mold, in particular over the circumference of the die cavity. The incipient solidification of the slab just below the bath level in the permanent mold proceeds differently on straight sections of the circumference of the die cavity from the fillet areas. The heat flow on the straight or substantially straight sections is quasi one-dimensional and follows the law of heat transmission through a flat wall. In contrast to this, the heat flow in the rounded corner areas is two-dimensional and it follows the law of heat transmission through a curved wall.

The resulting slab shell is normally thicker in the corner areas at the start of solidification below the bath level than on the straight surfaces and begins to shrink sooner and more intensely. The result of this is that even after about 2 seconds the slab shell lifts up irregularly from the wall of the permanent mold in the corner areas and air gaps form, which drastically impair the heat transmission. Not only does this impairment of the heat transmission delay the further growth of the shell, but it can even cause a re-fusion of already solidified inner layers of the slab shell. This fluctuating pattern of the heat flow—cooling and re-heating—leads to slab defects such as surface and internal longitudinal cracks at the edges or in areas near the edges, and also to mold defects such as rhomboidity, indents, etc. A re-fusion of the slab shell or larger longitudinal cracks can also lead to fractures.

The larger the fillets are dimensioned compared with the side length of the slab cross-section, in particular if the fillet radii amount to 10% or more of the side length of the die cavity cross-section, the more frequently such slab defects occur. This is one reason why the fillet radii are usually limited to 5 to 8 mm, although larger roundings at the slab edges would be more favorable for the subsequent rolling.

During casting at high casting speeds the dwell time of the cast slab in the permanent die cavity is reduced and the slab shell has overall less time to grow in thickness. Depending on the slab format chosen it is therefore necessary to support the slab shell with support rollers immediately after it leaves the permanent mold in order to avoid bulging of the slab shell or even fractures. Support roller stands of this kind directly beneath the permanent mold are exposed to great wear and can be restored to service after a fracture only with great expenditure of time and cost.

A permanent mold for continuous casting of billet and bloom slabs is known from JP-A-11 151555. In order to avoid rhomboid deformation of the slab cross-section when casting rectangular slabs and in order additionally to increase the casting speed, the fillets are specially shaped at the four corners of the die cavity as so-called corner cooling parts. On the pouring-in side the corner cooling parts are constructed as circular recesses in the wall of the permanent mold, which become smaller in the moving direction of the slab and reform to a corner fillet towards the exit of the permanent mold. The degree of curvature of the circular recesses increases in the moving direction of the slab towards the exit of the permanent mold. This shaping is intended to ensure uninterrupted contact between the corner area of the slab shell and the specially shaped corner cooling parts of the permanent mold.

From JP-A-09 262641 a tubular permanent mold is known for the continuous casting of rectangular slabs, which in order to avoid longitudinal cracks at the slab edges and rhombus-shaped slab cross-sections in the die cavity, employs fillets with different corner radii at the upper and lower end of the permanent mold. The upper corner radius at the inlet side of the permanent mold is chosen to be smaller than the corner radius at the outlet side of the permanent mold. This measure is said to avoid an air gap between the slab shell and the wall of the permanent mold. No details are given or implied regarding the size of the fillets in relation to the side length of the slab cross-section and the absolute size of the slab cross-section, nor is any information given or implied concerning simplifying the support guidance adjoining the permanent mold.

SUMMARY OF THE INVENTION

The object of the invention is to create a continuous steel casting plant for billet and bloom formats, preferably with a substantially rectangular slab cross-section, or one similar to rectangular, which achieves a combination of the following partial results. It should ensure on the one hand a high casting capacity with as small a number of slabs as possible, and thereby minimum investment and maintenance costs, and on the other hand an improved slab quality. The improvement in the slab quality should in particular prevent slab defects in the corner areas, such as cracks, solidification defects and casting powder inclusions in the slab shell, but also deviations in dimensions, such as rhomboidity, bulges and indents. The continuous casting plant according to the invention should furthermore reduce investment and maintenance costs for support guide stands and additionally improve the profitability and slab quality when permanent mold stirring devices are used.

With the continuous casting plant according to the invention it is possible to cast larger billet and bloom formats and preform slabs at higher casting speeds and without a support guide, or with a guide of reduced support width and/or support length, immediately below the permanent mold. At a preset production capacity the number of slabs can thereby be reduced and investment costs saved. At the same time the maintenance costs of the plant are reduced both because of the smaller number of slabs and because of the omission or reduction of support guides for the cast slabs. By enlarging the edge roundings of the cast slabs critical stresses in the remaining flat slab shell, produced by the ferrostatic pressure of the liquid core, can be considerably reduced when the slab emerges from the permanent mold. A shortening of the straight sections of the circumference of the die cavity located between the rounded-out corners by 10%, for example, reduces the flexural stress in these sections, likely to cause a bulge, by approximately 20%.

Besides these economic advantages, the slab quality is additionally improved in a great many respects. By controlling a selective elimination of the gap between the slab shell and the wall of the permanent mold or selective reshaping of the slab shell in the area of the fillet arc, the growth of the slab shell is evened out over the circumference of the slab and over predetermined parts of the length of the permanent mold, thereby improving the slab structure and preventing slab defects such as cracks, etc., in the edge areas. Additionally, geometric slab defects such as rhomboidity, bulges, etc., can be reduced or eliminated. However, enlargement of the rounded-out corners also influences the flow ratios in the region of the bath level. If casting powder is used to cover the bath level, with increasing enlargement of the rounded-out corners an evening-out of the conditions for the re-fusion of the casting powder can be achieved on the entire circumference of the meniscus. This advantage is further recognizable in permanent molds with stirring devices. Slab defects such as casting powder and slag inclusions, in particular in the edge areas, but also slab surface defects, can be reduced by evening-out the lubricating effect of the casting powder. Additional quality advantages are achievable by adapting the size of the rounded edges of the slab to the requirements of the subsequent rolling or forging operations.

The boundary between a support guide in the secondary cooling zone without a slab support and with a slab support of reduced support width and support length is determined by numerous parameters, in particular by the bulging behavior of a cast slab. Besides the main parameters of format size and overall length of the rounded-out portions of the two fillet arcs associated with a slab side or the length of a straight section between the two fillet arcs associated with a slab side, the casting speed, length of the die cavity, steel temperature and steel analysis, etc. are also decisive.

For tests to determine the boundary between a secondary cooling zone without support and a reduced support guide in the secondary cooling zone the following guideline values are provided. With slab formats which are smaller than approximately 150×150 $mm^2$ and with an overall length of the two rounded-out portions of a slab side of approximately 70% or more of the dimension of the slab side, it is usually possible to cast without support. With slab formats which are larger than approximately 150×150 $mm^2$ and have a straight section between the two rounded-out portions of approximately 30% or more of the dimension of the slab side, a support guide of reduced support width and support length can be arranged in the secondary cooling zone.

By means of the teaching according to the invention, on the one hand by enlarging the rounded-out portions, for example to 100% of the side length of the slab cross-section, and on the other hand by changing the degrees of curvature of successive fillet arcs in the moving direction of the slab, the bulging behavior of the slab after leaving the permanent mold can be influenced in such a way that, compared with the prior art, considerably larger slab formats can be produced without a support guide or with a reduced support guide, even at higher casting speeds.

Fillet arcs in the circumferential line of the cross-section of the die cavity can be formed from circular lines, composed circular lines, etc. Advantages of the invention are achievable if the fillet arcs do not adjoin the straight sections of the circumferential line tangentially or in a punctiform manner. Further, a curvature course along the fillet arc can be chosen that increases to a maximum degree of curvature 1/R and then decreases. The maximum degree of curvature 1/R in successive fillet arcs in the moving direction of the slab can reduce continuously or discontinuously. For producing the die cavity by means of NC-controlled cutting machine tools, it is straightforward if the circumferential lines of the slab cross-section have fillet arcs with curvature courses which follow a mathematical function and increase to a maximum degree of curvature 1/R and then decrease, such as for example mathematical functions such as a super circle or super ellipse.

With fillet arcs with fillet dimensions of 25% or more of the side length of the slab cross-section the advantages of the invention can be achieved if the substantially rectangular die cavity cross-section consists of four bow lines, each enclosing approximately a quarter of the circumference of the cross-section, and the bow lines follow a mathematical function. The mathematical function $$\left(\frac{|x|}{A}\right)^n + \left(\frac{|y|}{B}\right)^n = 1$$

fulfils this condition for example if an exponent "n" of between 3 and 50, preferably between 4 and 10, is chosen. A and B are the dimensions of the bow line.

The circumferential line of the slab cross-section can also be composed of several bow lines, the fillet arcs having a curvature course which follows a mathematical function, e.g. $|X|^n+|Y|^n=|R|^n$. Sections of the circumferential line arranged between the fillet arcs may have slightly curved bow lines, as described in EP patent specification 0 498 296, which is incorporated by reference in its entirety. Seen in the moving direction of the slab, the degrees of curvature 1/R of both the fillet arcs and the relatively stretched bow lines located between them can decrease in such a way that at least on a partial length of the permanent mold the slab shell is slightly deformed, i.e., stretched, on traversing the entire circumference.

Depending on the casting format chosen and envisaged maximum casting speed, an optimum length for the permanent mold can be determined. Casting formats between 120×120 $mm^2$ and 160×160 $mm^2$ can optimally be cast at high casting speeds with a length of the permanent mold of approximately 1000 mm, omitting a slab support.

Large rounded corners in the die cavity create advantages not only in casting with a casting powder covering of the bath level. With increasing size of the rounded corner it is also possible to increase the stirring effect in the bath level and in the liquid sump with constant electrical stirrer power. This possibility of improving the stirring power by the geometric shaping of the die cavity creates additional structural freedoms in installing stirrers in the billet and bloom permanent molds.

BRIEF DESCRIPTION OF THE DRAWINGS

The foregoing and other features of the present invention will be more readily apparent from the following detailed description and drawings of illustrative embodiments of the invention where like reference numbers refer to similar elements throughout and in which:

FIG. 2 shows a plan view of a copper pipe of a bloom permanent mold in accordance with the invention embodiments of.

DESCRIPTION OF EMBODIMENTS OF THE INVENTION

Figure 1:
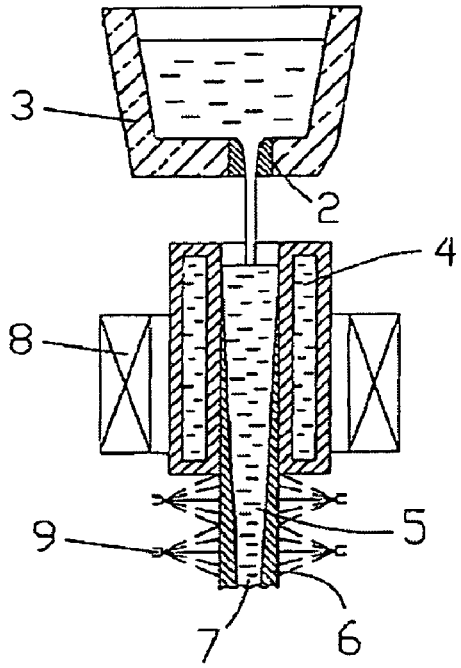
FIG. 1 shows a vertical section through part of a continuous casting plant in accordance with embodiments of the invention.

In FIG. 1 liquid steel flows vertically into a permanent mold 4 through a discharge nozzle 2 of an intermediate vessel 3. The permanent mold 4 has, for example, a rectangular die cavity for a billet cross-section of 120×120 $mm^2$. A partially solidified slab is denoted by 5, a slab shell is denoted by 6 and a liquid core is denoted by 7. A height-adjustable electromagnetic stirring device 8 is illustrated schematically outside the permanent mold 4. It can also be arranged inside the permanent mold 4, for example in the water jacket. The stirring device 8 produces a horizontally circulating rotary movement in the region of the bath level and in the liquid sump. Immediately adjoining the permanent mold 4 is a first secondary cooling zone, without slab support and provided with spray nozzles 9.

Figure 2:
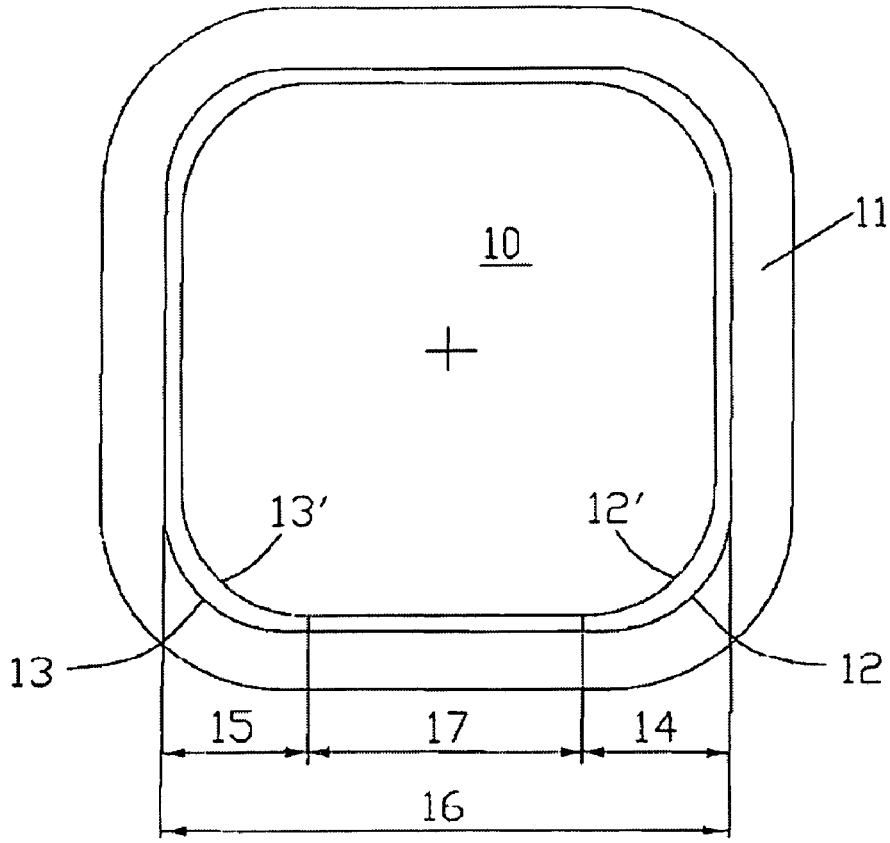

In FIG. 2 a die cavity, denoted by 10, of a permanent mold pipe 11 is provided with fillet arcs 12, 12', 13, 13' in the corner areas. The rounded-out portion 14, 15 of the fillet arcs 12, 12', 13, 13' amounts in this example to approximately 20% each of a side length 16 of the slab cross-section. However other proportions may be used. The degree of curvature 1/R of the pouring-in side fillet arc 12, 13 is different from the degree of curvature 1/R of the fillet arc 12', 13' at the exit of the permanent mold. At least along a partial length of the overall length of the permanent mold the degree of curvature 1/R of the fillet arc 12, 13, for example 1/R=0.05, decreases to a degree of curvature 1/R of the fillet arc 12', 13', for example 1/R=0.046. By choosing the size of the decrease in the degree of curvature, an elimination or prevention of a gap between the forming slab shell and the wall of the die cavity or selective deformation of the slab shell is achieved, and therefore the heat flow between the slab shell and the die cavity wall can be selectively controlled. Besides the increased and, seen over the circumference, evened-out heat flow, the size of the rounded-out portions 14, 15 also contributes to the fact that, in spite of the high casting speed, the partially solidified slab can be guided through the secondary cooling zone immediately after leaving the die cavity without or with reduced slab support. With a preset format, by enlarging the rounded-out portions 14, 15 a straight section 17 between the rounded-out portions 14, 15 can be selectively decreased in such a way that damaging bulges in the slab shell can be avoided in spite of the secondary cooling zone having no slab support. With large formats or if for technical reasons the size of the rounded-out portions is limited, a slab support of reduced support width can be provided.

Figure 3:
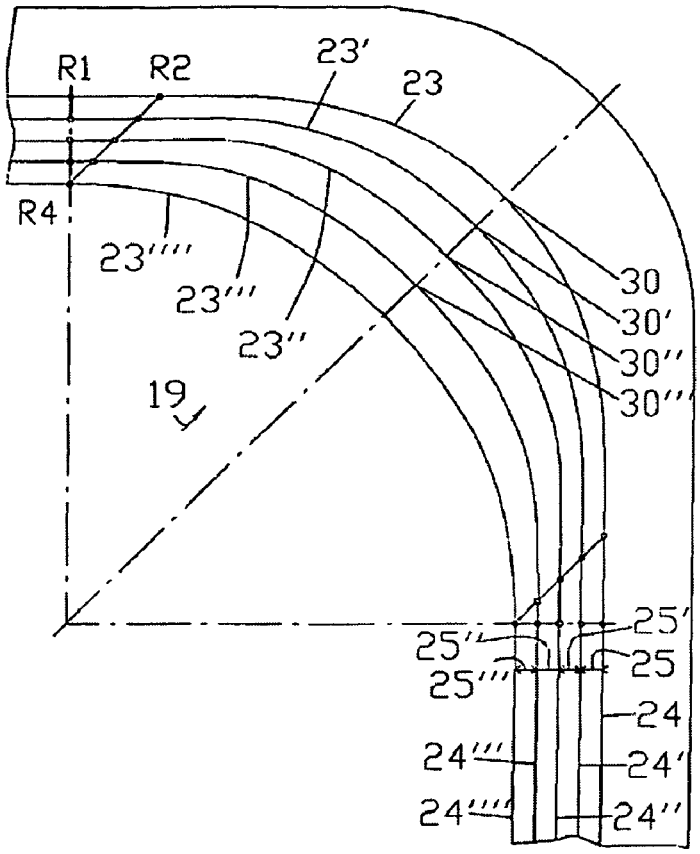
FIG. 3 shows a plan view of a corner construction of a die cavity with fillet arcs in accordance with embodiments of the invention.

In FIG. 3 a corner 19 of a die cavity is illustrated on an enlarged scale. Five fillet arcs 23-23'''' represent the geometry of the corner construction by way of vertical curves. The contact points of the fillet arcs 23-23'''' with the straight sections 24-24'''' of circumferential lines of the cross-section of the permanent mold can be chosen along the lines R, $R_4$ or $R_1$, $R_4$. The distances 25-25''' in this example show a constant conicity along the straight side walls. The fillet arcs 23-23'''' are defined by a mathematical curve function $|X|^n+|Y|^n=|R|^n$, wherein, by choosing the exponent "n," different degrees of curvature can be fixed. The degree of curvature of the fillet arcs 23-23''' is different along the arc. It expands to a maximum degree of curvature at the point 30-30''' and then decreases. In the moving direction of the slab the maximum degree of curvature decreases from fillet arc to fillet arc. The fillet arc 23'''' is in this example a circular arc. The exponents of the fillet arcs are in this example chosen as follows:

| | |
|---|---|
| fillet arc 23 | exponent "n" = 4.0 |
| fillet arc 23' | exponent "n" = 3.5 |
| fillet arc 23'' | exponent "n" = 3.0 |
| fillet arc 23''' | exponent "n" = 2.5 |
| fillet arc 23'''' | exponent "n" = 2.0 (circular arc) |

By the selection of the exponents the degree of curvature of the successive fillet arcs 23-23'''' in the moving direction of the slab is changed or decreased in such a way that an elimination of the gap between the slab shell and the wall of the permanent mold or a selective deformation of the slab shell in the area of the fillet arcs 23, 23'''' can be selectively controlled. This control of the elimination of the gap or slight reshaping of the slab shell allows the desired heat transmission to be controlled, and in particular an evening-out of the desired heat transmission along the fillet arcs is achieved in all corner areas of the slab when it passes through the die cavity.

Figure 4:
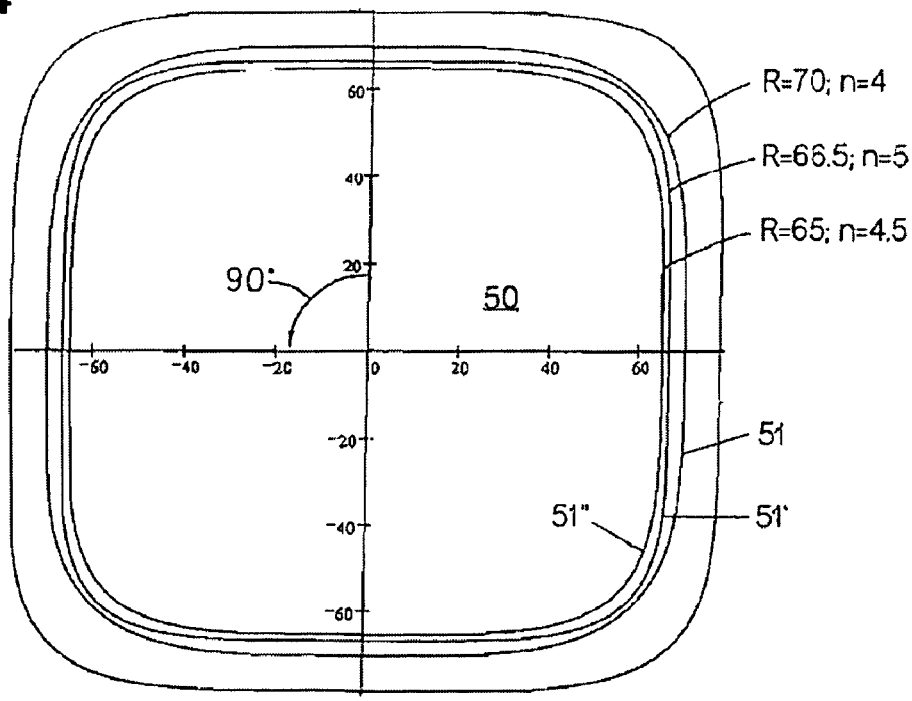
FIG. 4 shows a plan view of a copper pipe with circumferential lines of the die cavity cross-section in accordance with embodiments of the invention.

In FIG. 4 only three successive circumferential lines in the moving direction of the slab with fillet arcs 51-51'' of a square die cavity 50 are illustrated, to give a clear view. The circumferential lines are each composed of four fillet arcs 51-51'', enclosing an angle of 90°.

For calculating the circumferential lines 51-51'' the following mathematical function was used: $|X|^n+|Y|^n=|R-t|^n$.

The following numerical values were used as the basis of this example.

| Circumferential line | Exponent n | R − t | t |
|---|---|---|---|
| 51 | 4 | 70 | 0 |
| 51' | 5 | 66.5 | 3.5 |
| 51'' | 4.5 | 65 | 5 |

To achieve a deformation of the slab shell, in particular along the substantially straight side walls between the corner areas (convex technology) along a pouring-in side upper partial length of the permanent mold, an exponent "n" of 4 is chosen at bow line 51 and of 5 at bow line 51', following in the moving direction of the slab. In a lower partial length of the permanent mold the exponent 5 of the bow line 51' is decreased to 4.5 at the bow line 51" and therefore an optimum corner cooling is achieved.

This enlargement of the exponent "n" from 4 to 5 indicates that in the upper partial length of the permanent mold a deformation of the slab shell takes place at the substantially straight side walls between the corner areas, and in the lower partial length of the permanent mold by decreasing the exponent "n" from 5 to 4.5 an optimum contact of the slab shell and possibly a slight deformation of the slab shell takes place in the corner areas of the die cavity.

Figure 5:
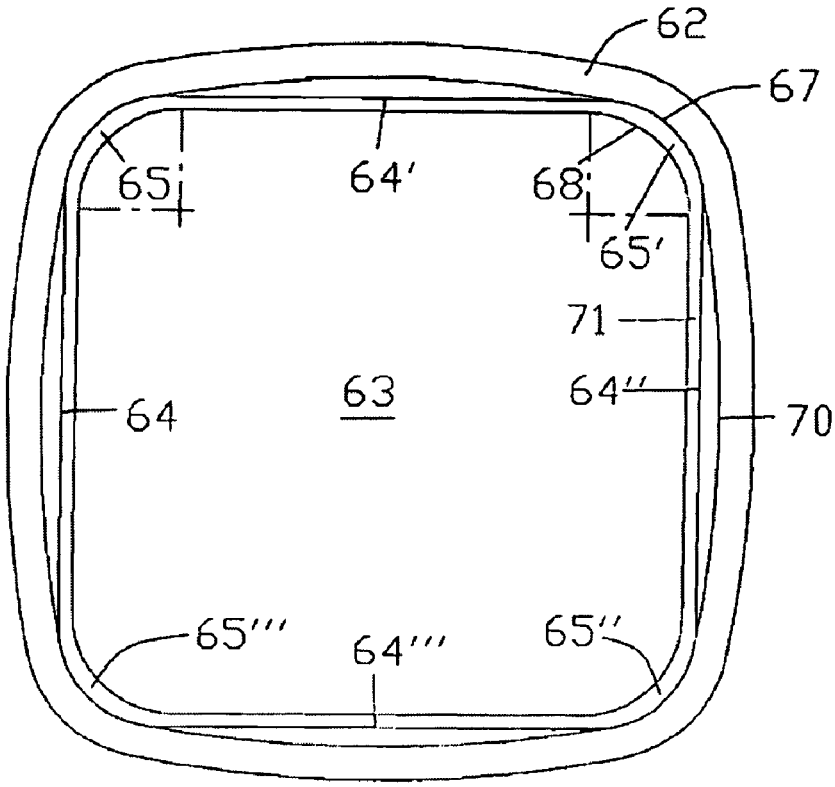
FIG. 5 shows a plan view of a copper pipe with circumferential lines of a die cavity cross-section in accordance with other embodiments of the invention.

FIG. 5 shows a tubular permanent mold 62 for the continuous casting of billet or bloom formats with a die cavity 63. The cross-section of the die cavity 63 is square at the exit of the permanent mold and corner areas 65-65''' are arranged between adjacent side walls 64-64'''. The fillet arcs 67, 68 are not circular lines but curves, according to the mathematical function $|X|^n+|Y|^n=|R|^n$, wherein the exponent "n" has a value between 2 and 2.5. In the upper part of the permanent mold part the side walls 64-64''' between the corner areas 65-65''' are concavely shaped on a partial length of 40% to 60% of the length of the permanent mold. On this partial length an arc height 66 decreases in the moving direction of the slab. A convex slab shell forming in the permanent mold is flattened along the upper partial length of the permanent mold. The bow line 70 may be formed by a circular line, a composed circular line or by a curve based on a mathematical function. In the lower partial length of the permanent mold the straight side walls 71 of the permanent mold are provided with a conicity of the die cavity corresponding to the shrinkage of the slab cross-section.

For simplification, all the mold cavities in FIGS. 1 to 5 are provided with a straight longitudinal axis. However, the invention can also be applied to permanent molds with a curved longitudinal axis for circular arc continuous casting plants. The configuration of the die cavity according to the invention is furthermore not restricted to tubular permanent molds. It can also be applied to plate or block permanent molds, etc.

Figure 6:
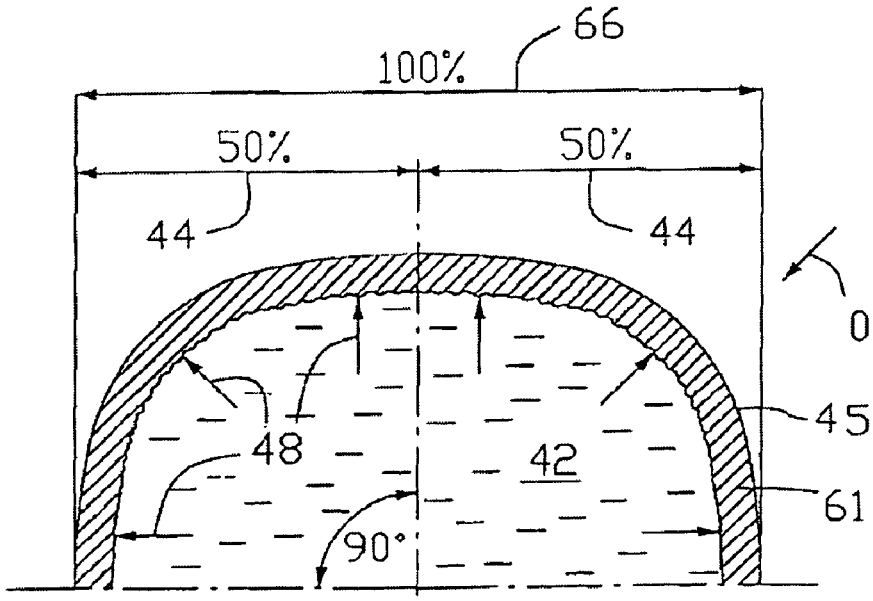
FIG. 6 shows a horizontal section through a half slab in a secondary cooling zone in accordance with embodiments of the invention.

In FIG. 6 half a substantially rectangular slab cross-section 60 is illustrated, with a solidified slab shell 61 and a liquid core 42. The circumferential line of the half slab cross-section 60 is composed of two partial curves 45, enclosing an angle of 90°, the shape of which corresponds to the initial cross-section of the die cavity of the permanent mold. The partial curves 45 follow the mathematical relation $$\left(\frac{|x|}{A}\right)^n+\left(\frac{|y|}{B}\right)^n=1$$

The length of each rounded-out portion 44 of the partial curves 45 amounts to 50%, or both rounded-out portions 44 together correspond to 100% of the dimension of the slab side 66. Arrows 48 indicate the ferrostatic pressure acting on the slab shell 61. The sum of the two rounded-out portions 44 of the partial curves 45 is greater than 70% of the dimension of the slab side 66 and a slab support in the secondary cooling zone is thus not necessary in this example.

Figure 7:
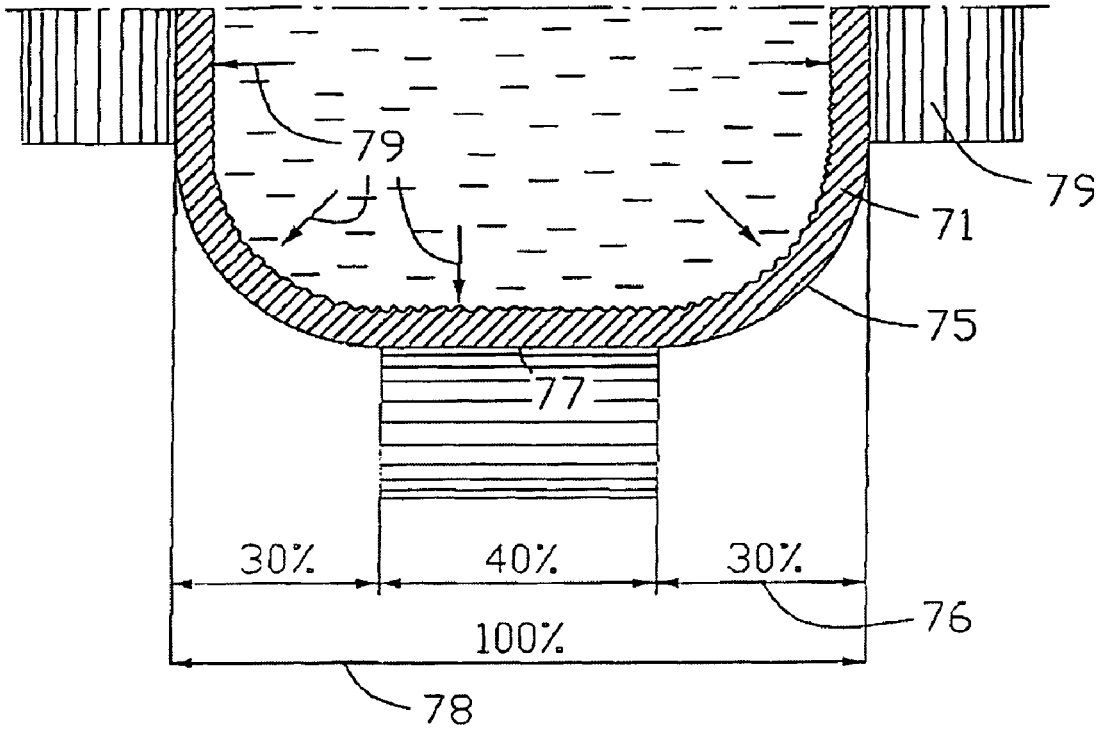
FIG. 7 shows a horizontal section through a half slab in a secondary cooling zone in accordance with other embodiments of the invention.

In FIG. 7, compared with FIG. 6 the circumferential line of the half slab cross-section is composed of two circular arcs 75 with a rounded-out portion dimension 76 of 30% and straight sections 77 of 40% of the dimension of the slab side 78. The straight sections 77 between the circular arcs 75 are in this example more than 30% of the dimension of the slab side 78, and a support guide of reduced support width and support length can be arranged in the form of support rollers 79. A width of the support rollers corresponding to the length of the straight section or slightly smaller than this is usually sufficient. Arrows 79 indicate the ferrostatic pressure acting on the slab shell 71.

Figure 8:
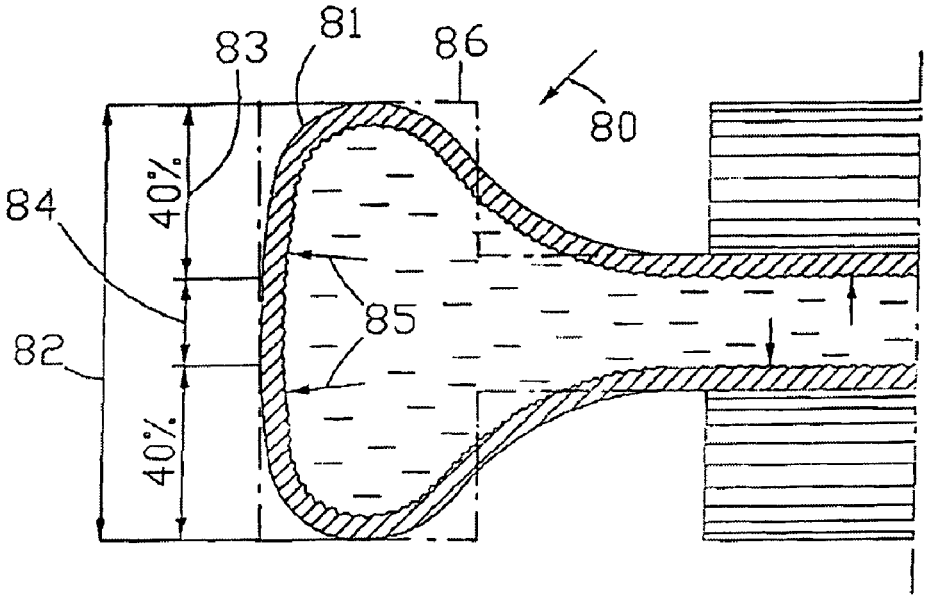
FIG. 8 shows a horizontal section through a half preform slab in a secondary cooling zone in accordance with other embodiments of the invention.

An example of a bloom slab in the shape of a preform section 80 for an H-steel is illustrated in FIG. 8. A die cavity for preform sections 80 also has corners 86, which are rounded out with fillet arcs 81. A slab side dimension 82 is composed of two fillet arcs 81 with rounded-out portions 83 of for example 40%, and a substantially straight section 84 of for example 20%. The ferrostatic pressure on the slab shell 86, indicated by arrows 85, generates a bulge in H-steel slabs according to the prior art, if the shaping is not arranged, as in this example, by special measures by choosing appropriate fillet arcs 81 or an appropriate support guide. In the illustrated example, by the choice of the length and geometry of the rounded-out portions 83 in the form of a super ellipse a slab shell is formed which withstands the ferrostatic pressure without support guide. With increasing slab side dimension 82, with appropriate dimensioning of the two rounded-out portions a reduced support guide in the secondary cooling zone may be sufficient.

In FIGS. 6 to 8 the horizontal sections through the slabs are illustrated immediately after leaving the permanent mold. For simplification and a better view the spray nozzles that may be arranged in a secondary cooling zone have been omitted.

Those skilled in the art will recognize that the materials and methods of the present invention will have various other uses in addition to the above described embodiments. They will appreciate that the foregoing specification and accompanying drawings are set forth by way of illustration and not limitation of the invention. It will further be appreciated that various modifications and changes may be made therein without departing from the spirit and scope of the present invention, which is to be limited solely by the scope of the appended claims.

What is claimed is:

1. Continuous casting plant comprising:

a permanent mold having a die cavity adapted so that liquid metal can be fed substantially vertically into said die cavity to form a strand shell that moves along said die cavity; and a secondary cooling zone adjoining said permanent mold;

wherein circumferential lines bounding said die cavity in cross-section comprise at least one side length having fillet arcs in corners thereof with rounded-out portions, said rounded-out portions occupying at least about 20% of said at least one side length and having a curvature that increases to a maximum degree of curvature 1/R and then decreases, wherein R is the radius; and wherein along said die cavity in the direction that said strand shell moves, the maximum degree of curvature 1/R is reduced so that said strand shell deforms adjacent to said fillet arcs.

2. Continuous casting plant of claim 1, wherein said at least one side length has a length of less than about 150 mm and said secondary cooling zone does not have a support guide therefor.

3. Continuous casting plant of claim 1, wherein said at least one side length has a length of more than about 150 mm, and said secondary cooling zone further comprises a support guide therefor having a support width substantially corresponding to a length of a straight portion of said at least one side length between said fillet arcs.

4. Continuous casting plant of claim 3, wherein said support guide includes rollers.

5. Continuous casting plant of claim 1, wherein said rounded-out portions comprise at least about 70% of said at least one side length and said secondary cooling zone does not have a support guide therefor.

6. Continuous steel casting plant according to claim 1, wherein a straight portion of said at least one side length between said fillet arcs comprises more than about 30% of said at least one side length, and said secondary cooling zone further comprises a support guide therefor having a support width substantially corresponding to said straight portion's length.

7. Continuous casting plant of claim 6, wherein said support guide includes rollers.

8. Continuous casting plant of claim 1, wherein secondary cooling zone includes spray nozzles.

9. Continuous casting plant of claim 1, wherein said liquid metal comprises liquid steel.

10. Continuous casting plant of claim 1 adapted for billet and bloom formats.

11. Continuous casting plant of claim 1, wherein said maximum degree of curvature 1/R is reduced continuously along said die cavity.

12. Continuous casting plant of claim 1, wherein said maximum degree of curvature 1/R is reduced discontinuously along said die cavity.

13. Continuous casting plant of claim 1, wherein said die cavity has a substantially rectangular cross-section.

14. Continuous casting plant of claim 13, wherein each of said circumferential lines consists of four fillet arcs each bounding about one-quarter of said die cavity and having a curvature profile approximating $$\left(\frac{|x|}{A}\right)^n + \left(\frac{|y|}{B}\right)^n = 1,$$

wherein "n" is between about 3 and about 50.

15. Continuous casting plant of claim 14, wherein "n" about 4 and about 10.

16. Continuous casting plant of claim 1, wherein said fillet arcs have curvature profiles approximating $|X|^n+|Y|^n=|R|^n$, wherein X is the x-coordinate value of the curvature profile;

Y is the y-coordinate value of the curvature profile; and n is selected to provide a degree of curvature and at least portions of said circumferential lines between said fillet arcs comprise curved bow lines, the degree of curvature of which decreases along at least a portion of said die cavity in the direction that said strand shell moves, thereby deforming the strand shell as it moves therethrough.

17. Continuous casting plant of claim 1, wherein said die cavity has a casting conicity "t" in the direction that said strand shell moves approximating $|X|^n+|Y|^n=|R-t|^n$, wherein X is the x-coordinate value of the curvature profile;

Y is the y-coordinate value of the curvature profile; and n is selected to provide a degree of curvature.

18. Continuous casting plant of claim 1, wherein said die cavity is approximately 1000 mm long.

19. Continuous casting plant of claim 8, wherein said spray nozzles are arranged immediately adjoining said permanent mold and adapted to uniformly cool said strand shell.

20. Continuous casting plant of claim 1, further comprising at least one electromagnetic stirring device adapted to generate a generally horizontal circulatory motion of said liquid metal in said permanent mold.

* * * * *